US005680011A

United States Patent [19]

Makishima

[11] Patent Number: 5,680,011

[45] Date of Patent: Oct. 21, 1997

[54] COLD CATHODE DENSITY-MODULATED TYPE ELECTRON GUN AND MICROWAVE TUBE USING THE SAME

[75] Inventor: Hideo Makishima, Tokyo, Japan

[73] Assignee: NEC Corportion, Tokyo, Japan

[21] Appl. No.: 257,190

[22] Filed: Jun. 8, 1994

[30] Foreign Application Priority Data

Jun. 8, 1993 [JP] Japan ..... 5-137061

[51] Int. Cl.[6] ..... H01J 23/04; H01J 25/00

[52] U.S. Cl. ..... 315/3; 315/5.37; 315/5.33; 315/39.3; 313/309; 313/351

[58] Field of Search ..... 315/5.29, 5.33, 315/5.37, 39.3, 5.14, 5.16, 3; 313/309, 351

[56] References Cited

U.S. PATENT DOCUMENTS

| | | | |
|---|---|---|---|
| 2,974,253 | 3/1961 | Jepsen | 315/5.37 X |
| 3,091,719 | 5/1963 | Dyke et al. | 315/5.33 X |
| 3,107,313 | 10/1963 | Hechtel | 315/5.16 |
| 3,278,791 | 10/1966 | Favre | 315/39.3 X |
| 4,145,635 | 3/1979 | Tuck | 313/309 X |
| 5,124,664 | 6/1992 | Cade et al. | 313/309 X |
| 5,189,341 | 2/1993 | Itoh et al. | 315/169.1 |

FOREIGN PATENT DOCUMENTS

| | | | |
|---|---|---|---|
| 3-187127 | 8/1991 | Japan . | |
| 5-266809 | 10/1993 | Japan . | |
| 2256311 | 12/1992 | United Kingdom | 315/3 |

OTHER PUBLICATIONS

Robert E. Neidert, et al., "Field Emission Triodes", IEEE Transactions On Electron Devices, vol. 38, No. 3, Mar. 1991, pp. 661–665.

C.A. Spindt et al., "Physical properties of thin-film field emission cathodes with molybdenum cones", *Journal of Applied Physics*, vol. 47, No. 12, Dec. 1976, pp. 5248–5263.

P.M. Lally et al., "An X-Band Tuned Amplifier with a Field-Emission Cathode", *IEEE Transactions on Electron Devices*, vol. 36, No. 11, Nov. 1989, pp. 2738–2741.

M.A. Kodis et al., "The Emission Gated Device Experiment", *IEDM*, 1990, pp. 893–896.

H.H. Busta et al., "Triode Operaton of a Vacuum Transistor", *IEDM*, 1991, pp. 213–215.

*Primary Examiner*—Benny T. Lee

*Attorney, Agent, or Firm*—Sughrue, Mion, Zinn, Macpeak, and Seas

[57] ABSTRACT

Tips of emitters are protruded over a control electrode in a field emission cathode. The cathode is a part of an input cavity, and an anode facing the cathode is also a part of the input cavity. A voltage which is in the vicinity of a threshold value or less than the threshold value is applied across the control electrode and the emitters, so that an emission current is modulated in density by a RF input signal.

19 Claims, 6 Drawing Sheets

COLD CATHODE DENSITY-MODULATED TYPE ELECTRON GUN AND MICROWAVE TUBE USING THE SAME

FIELD OF THE INVENTION

The invention relates to a density-modulated type electron gun and a microwave tube using the same, and more particularly, to a density-modulated type electron gun using a field emission cathode in which electrons are emitted from sharp tip portions of emitters, and a microwave tube using the same.

BACKGROUND OF THE INVENTION

A conventional field emission cathode comprises minute or fine conical emitters for emitting electrons, and a control electrode provided adjacent to the emitters, as explained in "Journal of Applied Physics," Vol. 47, No. 12, 1976. The detail of the conventional field emission cathode will be explained immediately prior to the description of the preferred embodiments according to the invention.

A conventional amplifier using this kind of a field emission cathode is explained in "IEEE Trans. on Electron Devices, Vol. 36, No.11, 1989. The detail thereof will be also explained later.

A conventional emission gated device which comprises a thermal emission cathode, a helix circuit and a collector is explained in IEEE, International Electron Device Meeting, pp. 893–896, (1990), and a conventional Klystron type device in which an output strip line is disclosed in the Japanese Patent Kokai No. 3-187127.

The conventional emission gated device and the conventional Klystron type device are also to be explained in detail just prior to the description of the preferred embodiments according to the invention.

In the above described conventional technologies, however, there are disadvantages as set out below.

(1) IEEE Trans. on. ED

A capacitance value becomes large between the control electrode and a silicon substrate, so that it is difficult to effectively define a RF electric field across the control electrode and the emitters at a frequency of 1 GHz or more, because the control electrode and the substrate face each other for the cathode on the whole electron emission region by interposing a dielectric film of, for instance, $SiO_2$ therebetween. Further, when an area for the cathode is large to provide a high output, the similar disadvantage is observed, even if a frequency is low.

(2) International Electron Device Meetings '90

The upper limitation on an operation frequency is 1 GHz at most, because there is mechanical limitation on a distance between the cathode and a grid, and because a RF input signal is applied to the grid.

(3) Japanese patent Kokai No. 3-187127

If modulation coefficient of an electron beam is low, and high efficiency operation is not expected, because a constant amount of an electron beam is first modulated in velocity, and then modulated in density, and the density-modulated electron beam is coupled to the output strip line. Further, if the size is large, there is a possibility that the electron beam will be dispersed, because a distance is necessary to sufficiently convert the velocity-modulated electron beam to the density-modulated electron beam.

SUMMARY OF THE INVENTION

Accordingly, it is an object of the invention to provide a density-modulated type electron gun and a microwave tube using the gun, in which an operating frequency is high, and a modulation sensitivity is high.

It is a further object of the invention to provide a density-modulated type electron gun and a microwave tube using the gun, in which electrons colliding with an anode are decreased, and density-modulated electrons are generated with a high modulation coefficient.

It is a still further object of the invention to provide a density-modulated type electron gun and a microwave tube using the gun, in which the efficiency is high, the structure is simple, and the size is small.

According to the invention, a density-modulated type electron gun, comprises:

- a substrate being conductive on at least one surface thereof;
- electron emission electrodes provided on regions on the one surface of the substrate;
- an insulating layer provided on the one surface of the substrate, the insulating layer having apertures for exposing the regions;
- control electrode provided on the insulating layer, the control electrode having apertures corresponding to the insulating layer, the substrate, the electron emission electrodes, and the control electrode cooperating to provide a field emission cathode; and
- a cavity which is resonant at a frequency of a RF input signal, a part of the cavity being an anode facing the field emission cathode, the anode having an aperture for passing electrons emitted from the field emission cathode, the anode and the control electrode being separated by direct current potentials;
- wherein a first distance from the one surface of the substrate to tips of the electrons emission electrodes is greater than a second distance from the one surface of the substrate to exposed surfaces of the control electrodes.

According to a further feature of the invention, a microwave tube using a density-modulated type electron gun, comprises:

- a substrate being conductive on at least one surface thereof;
- electron emission electrodes provided on regions on the one surface of the substrate;
- an insulating layer provided on the one surface of the substrate, the insulating layer having apertures for exposing the regions;
- control electrode provided on the insulating layer, the control electrode having apertures corresponding to the insulating layer, the substrate, the electron emission electrodes, and the control electrode cooperating to provide a field emission cathode;
- an input cavity which is resonant at a frequency of a RF input signal, a part of the input cavity being an anode facing the field emission cathode, the anode having an aperture for passing electrons emitted from the field emission cathode, the anode and the control electrode being separated by direct current potentials, the field emission cathode and the input cavity cooperating to provide a density-modulated type electron gun;
- an output cavity connected to receive the electrons from the aperture of the anode to the density-modulated tube electron gun; and
- a collector for collecting the electrons from the output cavity;

wherein a first distance from the one surface of the substrate to tips of the electrons emission electrodes is greater than a second distance from the one surface of the substrate to exposed surfaces of the control electrodes.

According to a still further aspect of the invention, a microwave tube, comprises:

a substrate being conductive on at least one surface thereof;

electron emission electrodes provided on regions on the one surface of the substrate;

an insulating layer provided on the one surface of the substrate, the insulating layer having apertures for exposing the regions;

control electrode provided on the insulating layer, the control electrode having apertures corresponding to the insulating layer, the substrate, the electron emission electrodes, and the control electrode cooperating to provide a field emission cathode;

an input cavity which is resonant at a frequency of a RF input signal, a part of the input cavity being an anode facing the field emission cathode, the anode having an aperture for passing electrons emitted from the field emission cathode, the anode and the control electrode being separated by direct current potentials, the field emission cathode and the input cavity cooperating to provide a density-modulated type electron gun;

a slow-wave circuit for interacting with the electrons from the anode and a microwave signal; and a collector for collecting the electron after being interacted with the microwave;

wherein a first distance from the one surface of the substrate to tips of the electrons emission electrodes is greater than a second distance from the one surface of the substrate to exposed surfaces of the control electrodes.

BRIEF DESCRIPTION OF THE DRAWINGS

The invention will be explained in more detail in conjunction with appended drawings, wherein.

DESCRIPTION OF THE PREFERRED EMBODIMENTS

Before explaining a density-modulated type electron gun and a microwave tube using the gun in the preferred embodiments according to the invention, the aforementioned thin film field emission cathode will be explained.

Figure 1:
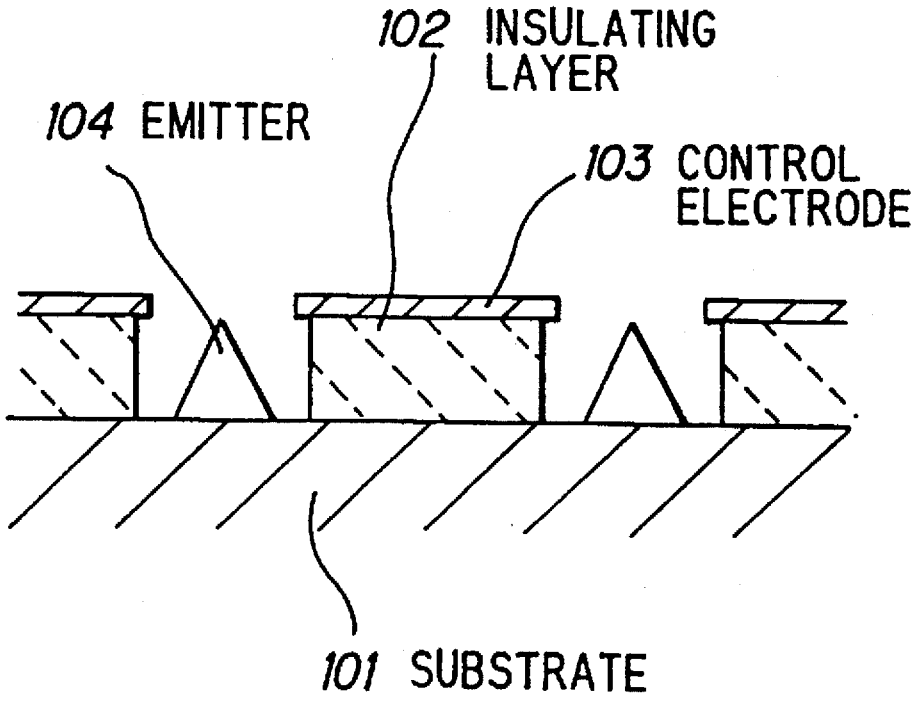
FIG.1 PRIOR ART
FIG. 1 is a cross-sectional view showing a conventional field emission cathode.

The thin film field emission cathode which is described on page 5249 to 5263 of "Journal of Applied Physics, Vol. 47, No. 12, 1976" is shown in FIG. 1. The thin film field emission cathode comprises a silicon substrate 101, a silicon dioxide insulating layer 102, a control electrode 103 provided on the insulating layer 102, and cone-shaped emitters 104.

In the thin film field emission cathode, the current density is high, and the velocity dispersion of emitted electrons is low, respectively, as compared to a thermal emission cathode. Further, current noise is low, and it operates with a low voltage of several tens to 200V in atmosphere of a relatively low vacuum degree as compared to a field emission cathode of a single emitter.

Figure 2:
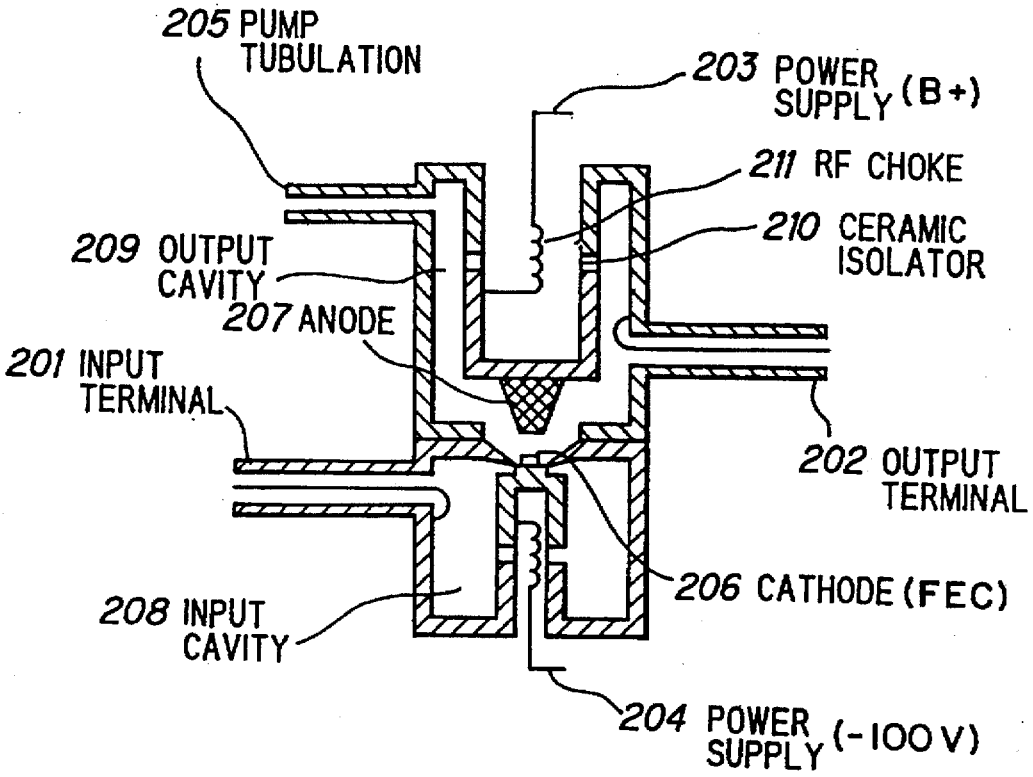
FIG. 2 PRIOR ART
FIG. 2 is an explanatory view showing a conventional tuned amplifier.

A tuned amplifier using a field emission cathode which is described on pages 2738 to 2741 of "IEEE Trans, on Electron Devices, vol. 36, No. 11, Nov. 1989" is shown in FIG. 2. The tuned amplifier using the field emission cathode (FEC) comprises an input coaxial terminal 201, an output coaxial terminal 202, a power supply ($B^+$) 203, a power supply (−100V) 204, a pump tubulation 205, a linear FEC 206, an anode 207, an input cavity 208, an output cavity 209, a ceramic isolator 210, and a RF choke 211.

In the tuned amplifier, an RF input signal is applied from the input coaxial terminal 201 via the input cavity 208 across a control electrode and an emitter (that is, the control electrode and a substrate) of the FEC 206. The insulating layer between the substrate and the control electrode is approximately 1 μm, and a curvature radius of the emitter's tip portion is less than approximately 100 Å, so that a high electric field is applied to the tip portion of the emitter to emit an amount of electrons proportional to the RF input signal. In accordance with the RF input signal, an electron beam which is modulated in density is accelerated to be propagated through the output cavity 209. Consequently, RF power is obtained at the output coaxial terminal 202.

Figure 3:
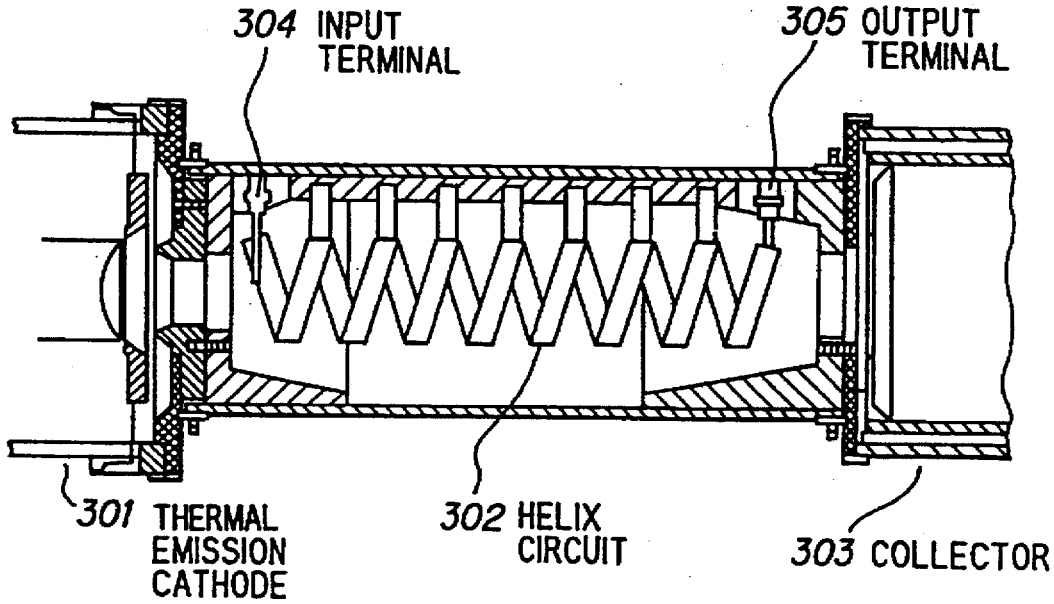
FIG. 3 PRIOR ART
FIG. 3 is an explanatory view showing a conventional emission gated amplifier.

An emission gated amplifier using a thermal emission cathode which is described in "International Electron Device Meeting '90, 35.6.1, 1990" is shown in FIG. 3. The amplifier comprises a thermal emission cathode 301, a helix circuit 302 having input and output terminals 304 and 305, respectively, and a collector 303.

In the amplifier, a RF input signal is applied to a grid positioned at the front stage of the thermal emission cathode 301 to emit an electron beam which is modulated in density. The density-modulated electron beam is propagated through the helix circuit 302 which is a slow-wave circuit to be collected by the collector 303, so that a RF power is induced on a helix conductor of the helix circuit 302. The induced RF power is obtained at the output terminal 305 of the helix circuit 302.

A Klystron type density-modulated device is disclosed in the Japanese Patent Kokai No. 3-187127. In the Klystron type density-modulated device, an electron beam drawn by a control electrode is propagated through an input strip line to be modulated in velocity, and the velocity-modulated electron beam is drifted through a drift section to be converted to a density-modulated electron beam which is then propagated through an output strip line, from which a predetermined output is obtained.

Figure 4A:
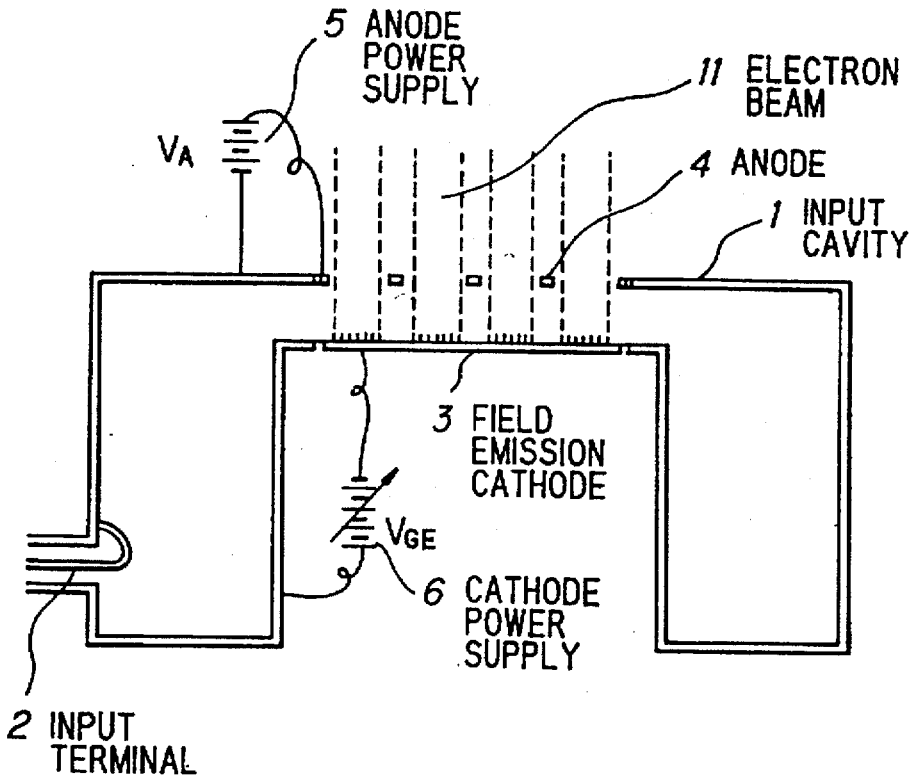
FIGS. 4A and 4B are explanatory views showing a density-modulated type electron gun in a first preferred embodiment according to the invention, and a cross-sectional view showing a field emission cathode used in the first preferred embodiment.

Next, a density-modulated type electron gun in the first preferred embodiment according to the invention will be explained in FIGS. 4A and 4B. In FIG. 4A, the density-modulated type electron gun comprises an input cavity 1 having a structure which is resonant at a frequency of an input signal, an input terminal 2 provided on the input cavity 1, a cathode 3 provided on the input cavity 1 to emit electrons in accordance with a RF input signal supplied to the input terminal 2, an anode 4 provided on the input cavity 1 to accelerate the electrons in the form of beam, a power supply 5 applying an acceleration voltage ($V_A$) to the anode 4 relative to the input cavity 1, and a power supply 6 applying a bias voltage ($V_{cc}$) across a control electrode and an emitter for the cathode 3.

Figure 4B:
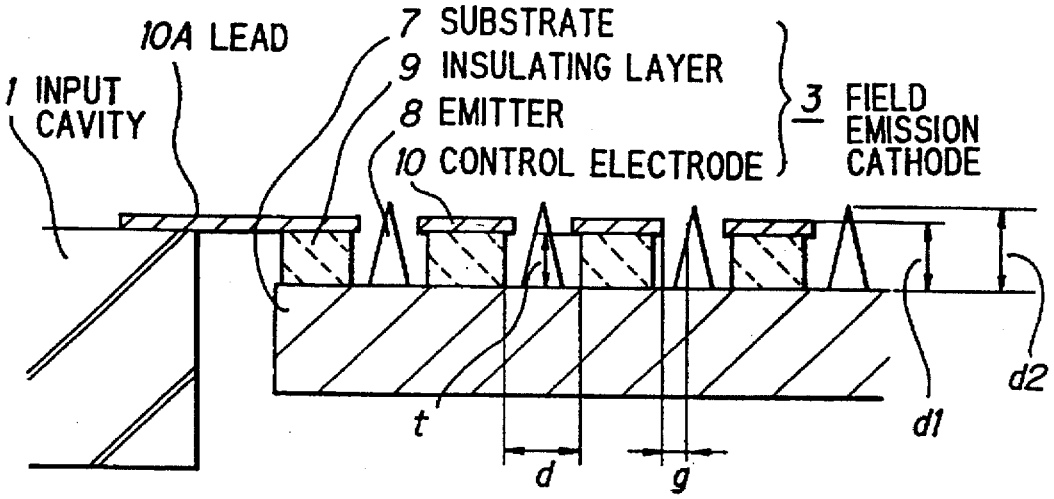

In FIG. 4B, the cathode 3 comprises a conductive substrate 7, an insulating layer 9 provided on the conductive substrate 7, a control electrode 10 provided on the insulating layer 9, and emitters 8 provided on removed portions of the insulating layer 9 and the control electrode 10. The emitters 8 are in ohmic contact with the substrate 7, so that the emitters 8 and the substrate 7 are at the same potential. In FIG. 4B, the distance d2 between the tip of the emitter 8 and the top surface of the substrate 7 is larger than the distance d1 between the top surface of the control electrode 10 and the top surface of the substrate 7, and the control electrode 10 is connected to an inner wall of the input cavity 1 by a lead 10A. The distance d2 is preferably larger than the distance d1 by 0.2 to 1 μm.

If the distance d2 is designed to be larger than the distance d1 by a difference of less than 0.2 μm, there is a possibility that the distance d2 will be less than the distance d1 in accordance with the thickness deviation of the insulating layer 9 and the control electrode 10. For one example, the gap g between the control electrode 10 and the emitter 8 is 0.5 μm.

In fabrication, the distance d2 can be sufficiently larger than the distance d1, when a ratio d/t is greater than 1, more preferably, greater than 1.5 in forming the emitters 8 by evaporation method, where d is a diameter of openings of the insulating layer 9, and t is a thickness of the insulating layer 9. On the other hand, when the emitters 8 are formed by etching method, the distance d2 (height) of the emitters 8 is first measured subsequently to the etching step, and the condition of forming or depositing films is set, such that the distance d1 (total thickness of the insulating layer 9 and the control electrode 10) is less than the distance d2.

In operation, the cathode power supply 6 (in FIG. 4A) applies a positive voltage of several volts to under one hundred volts to the control electrode 10 (in FIG. 4B) on the basis of a potential of the emitters 8 (in FIG. 4B), where the control electrode 10 and the emitters 8 are portions of FEC 3 (in FIGS. 4A and 4B). In this state, when no RF input signal is applied to the input terminal 2 (in FIG. 4A), it is set such that electrons are not substantially emitted form the emitters 8. On the other hand, a voltage of several kV is applied to the anode 4 (in FIG. 4B) relative to the input cavity 1 (in FIGS. 4A and 4B) and the control electrode 10 by the anode power supply 5 (in FIG. 4A). For the structure as shown in FIG. 4B, the emitters 8 are strongly affected by the potential of the control electrode 10 rather than the anode 4.

When a RF input signal is applied to the input terminal 2, a potential combined by direct current electric fields of the control electrode 10 and the anode 4 and an RF electric field of the RF input signal is applied to the tip portions of the emitters 8. Consequently, an amount of electrons which is dependent on the RF input signal is emitted from the emitters 8. The emitted electrons will comprise electron beams 11 (in FIG. 4A) of density-modulation which are accelerated and focused by the anode 4. The anode 4 is comprised of a meshed structure so that the cavity to the RF input signal does not restrict the electrons, such that the meshed apertures of the anode 4 face emission regions of the cathode 3, while the mesh of the anode 4, itself, faces non-emission regions of the cathode 3. For this structure, almost all of the electrons emitted from the cathode 3 are passed through the meshed apertures of the anode 4 without colliding with the mesh of the anode 4.

Figure 5:
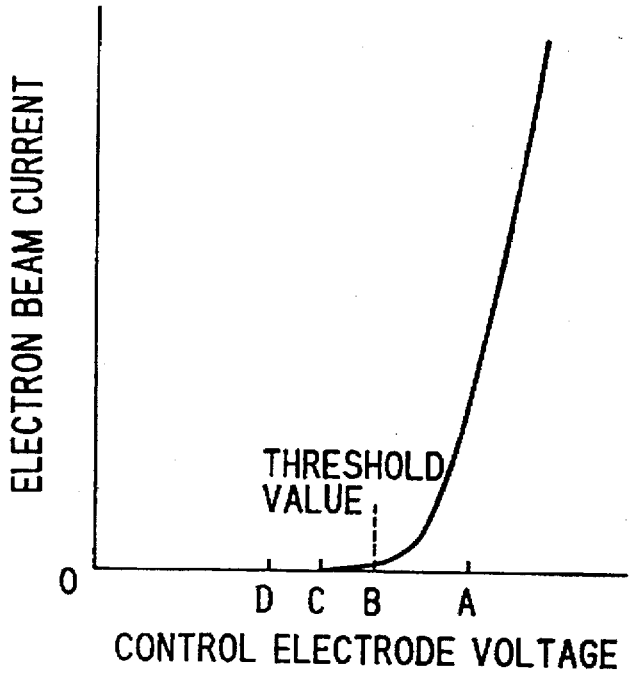
FIG. 5 is a graph explaining the relation between a voltage applied to a control electrode of a field emission cathode and an electron beam current in a density-modulated type electron gun.

FIG. 5 shows the general relation between a control electrode voltage and an electron beam current in a field emission cathode, wherein the current is abruptly increased, when the voltage is greater than a threshold voltage. When the control electrode voltage is set to the value D, no electron beam current flows in the absence of RF input power, while an electron beam current flows at a limited duration of the RF cycle, when the RF input power exceeds a given level. On the other hand, when the control electrode voltage is set to the value A, an electron beam current flows even in the absence of RF input power, with the electron beam current changeing in value depending on the RF input power. When the control electrode voltage is set to values between B and C, the resulting characteristics are between those for the values obtained for A and D.

As explained above, in accordance with the general discussion, the electron beam current is changed continuously between the first case of the value D, in which the conduction angle for flowing the electron beam current is small, the modulation coefficient is large, the amplifier efficiency is high, and the amplifier gain is relatively low, and the second case of the value A, in which the conduction angle is large, the amplifier efficiency is relatively low, and the amplifier gain is high. This is implemented by controlling a direct current voltage applied across the control electrode 10 and the substrate 7. The electric beam current is well regulated by a small RF input power, as compared to the case where no control electrode is provided, or no control voltage is applied to the control electrode 10.

Figure 6:
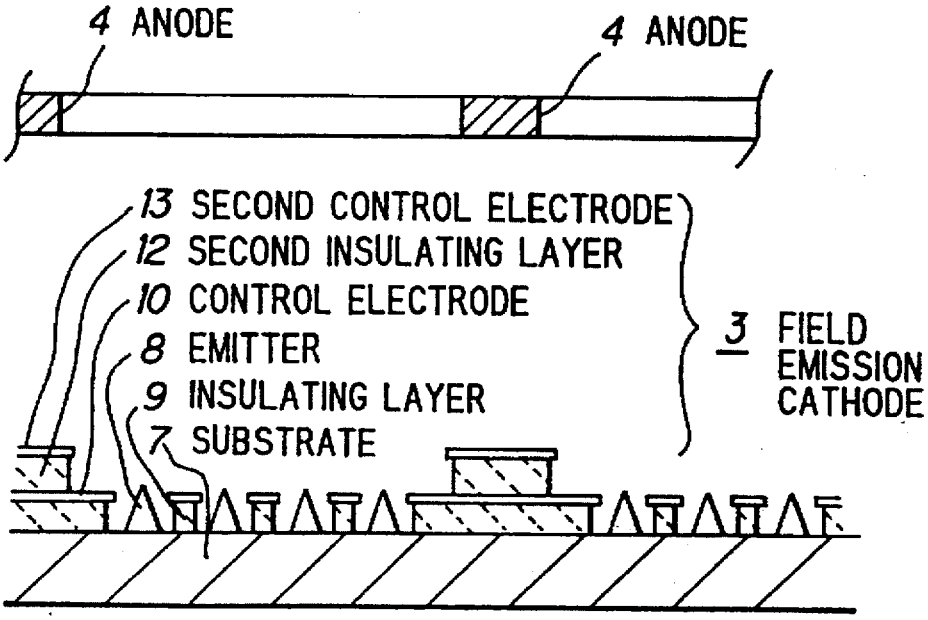
FIG. 6 is a cross-sectional view showing a cathode used in a density-modulated type electron gun in a second preferred embodiment according to the invention.

FIG. 6 shows a cathode for a density-modulated type electron gun in the second preferred embodiment according to the invention, wherein like parts are indicated by like reference numerals as used in FIGS. 4A and 4B. In the cathode 3, the reference numeral 12 indicates a second insulating layer provided the non-electron emission portion of the control electrode 10, and reference numeral 13 indicates a second control electrode provided on the second insulating layer 12.

In operation, a voltage which is more negative than that for the control electrode 10 by a small amount is applied to the second control electrode 13. Consequently, the possibility that part of the emitted electrons will collide with the mesh of the anode 4 is avoided. If the second electrode 13 is not provided, there is the possibility that part of the emitted electrons will collide with the mesh of the anode 4 due to a spatial charge effect in the electron beam, and scattering of the electron beam caused by the transverse component of electric force lines (formed in the vicinity of tip portions of the emitters 8).

Figure 7A:
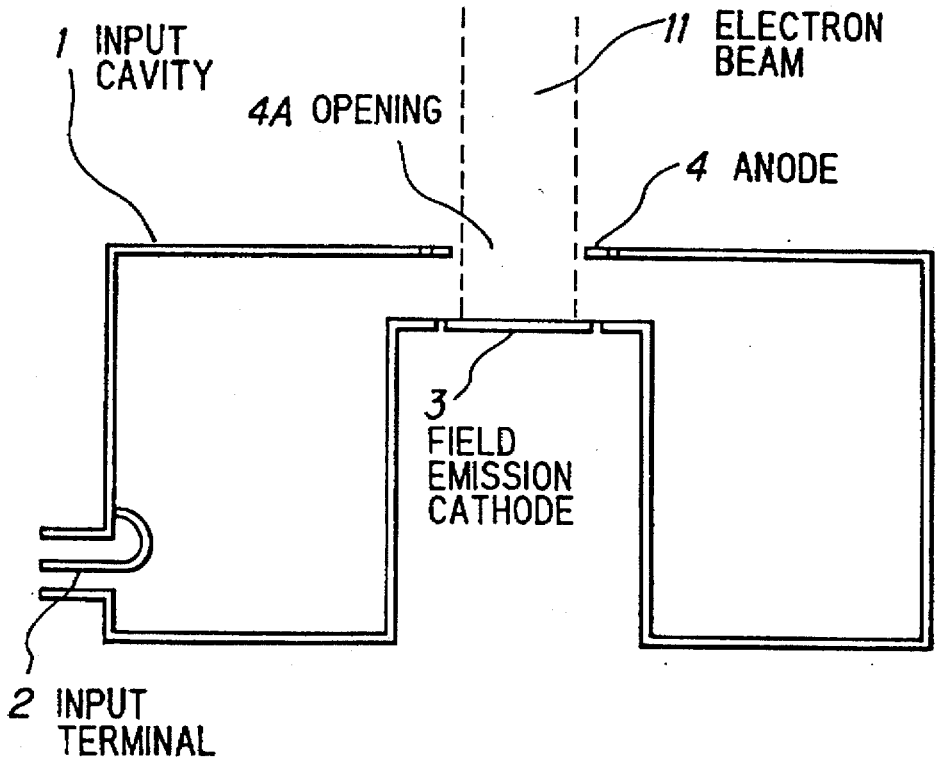
FIGS. 7A and 7B are explanatory views showing a density-modulated type electron gun in a third preferred embodiment according to the invention, and a cross-sectional view showing a field emission cathode used in the third preferred embodiment.
Figure 7B:
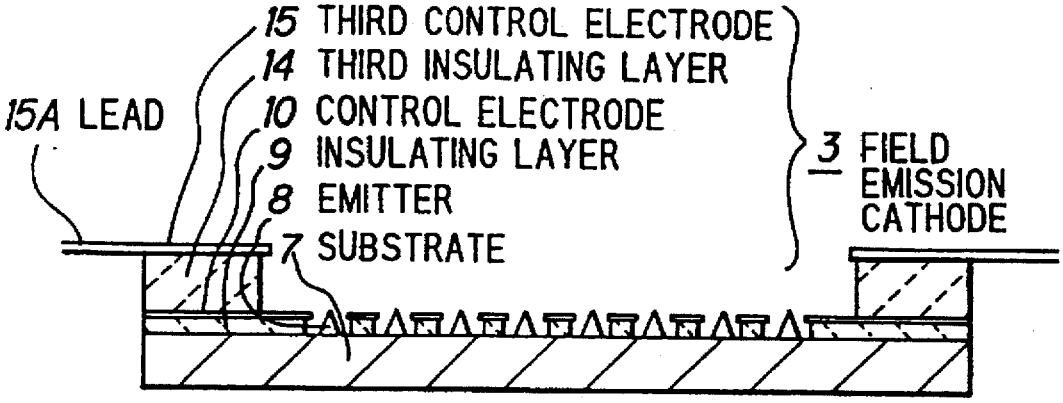

FIGS. 7A and 7B show a density-modulated type electron gun in the third preferred embodiment according to the invention, wherein like parts are indicated by like reference numerals as used in FIGS. 4A and 4B.

In FIG. 7A, an opening 4A is provided in place of the mesh in anode 4.

In FIG. 7B, the cathode 3 is provided with a third insulating layer 14 and a third control electrode 15 at a periphery of the cathode 3 where no electrons are emitted. The third control electrode 15 is connected to an inner wall of the input cavity by a lead 15A. In place of the lead 15A, the control electrode 10 may be connected thereto.

In operation, the third control electrode 15 functions in the same manner as the second control electrode 13 in the second preferred embodiment. The opening 4A of the anode 4 is dimensioned to be small as compared to a frequency in operation.

Figure 8:
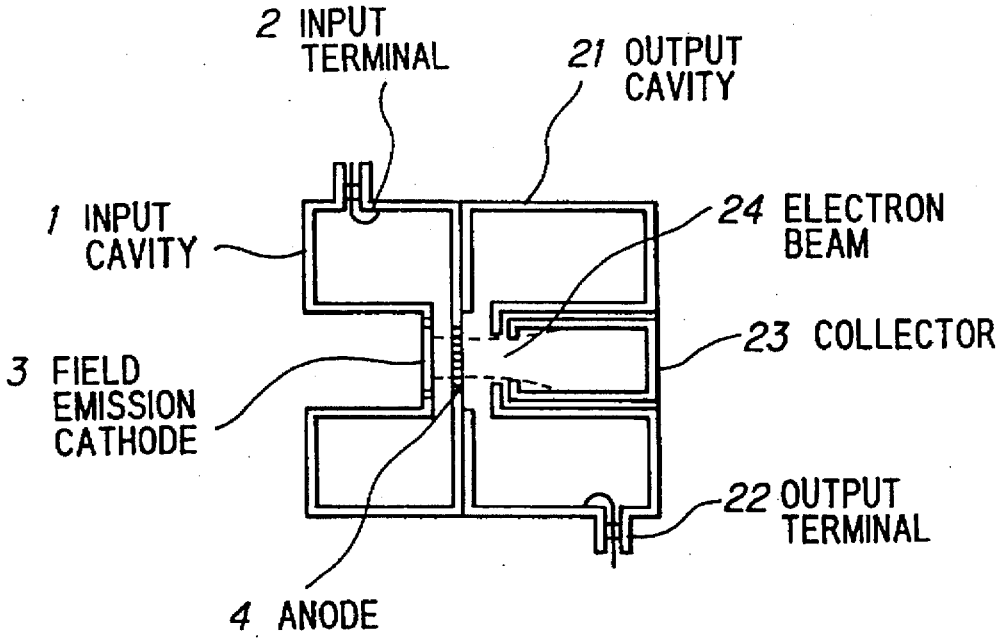
FIG. 8 is an explanatory view showing a microwave tube in a first preferred embodiment according to the invention.

FIG. 8 shows a microwave tube in the first preferred embodiment according to the invention, wherein like parts are indicated by like reference numerals as used in FIGS. 4A and 4B, and the preferred density-modulated type electron gun is used.

In operation, an electromagnetic field is induced in an output cavity 21 by a density-modulated electron beam 24, so that a RF power in the output cavity 21 is supplied to an exterior by an output terminal 22 provided on the output cavity 21. The density-modulated electron beam 24 passed through the output cavity is collected by a collector 23.

Figure 9:
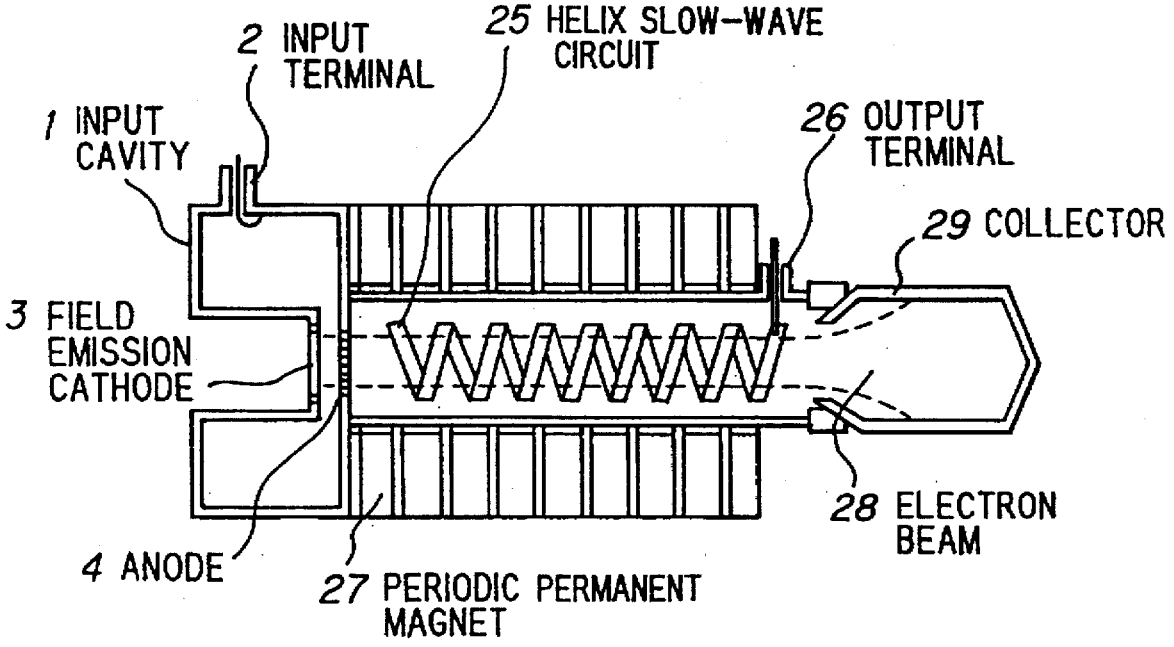
FIG. 9 is an explanatory view showing a microwave tube in a second preferred embodiment according to the invention.

FIG. 9 shows a microwave tube in the second preferred embodiment according to the invention, wherein like parts are indicated by like reference numerals as used in FIGS. 4A and 4B, and the preferred density-modulated type electron gun is used.

In operation, the density-modulated electron beam 28 which is generated and accelerated in the density-modulated type electron gun is propagated through a helix slow wave circuit 25 to generate a helix electromagnetic field. The helix electro-magnetic wave reacts with the electron beam 28 to amplify the electro-magnetic field, so that a RF power on the helix slow wave circuit 25 is obtained at an output terminal 26.

The scattering of the electron beam 28 is avoided by periodically arranged magnets 27, and it is collected by a collector 29. In this preferred embodiment, the helix slow wave circuit 25 may be replaced by a slow wave-circuit comprised of a coupling cavity or a ring loop.

In the preferred embodiments, a glass or ceramic substrate deposited with a conductive metal thin film may be used in place of the silicon substrate, and the emitters 8 fabricated by the deposition of a metal may be replaced by an etching of a semiconductor substrate.

"IEEE International Electron Device Meeting 1992" describes, on pages 213 to 215, the tip of the emitter which is protruded above the gate to initiate field emission by the collector. However, this material never discloses or suggests the application to an amplifier.

Further, the Japanese Patent Kokai Nos. 4-506280 and 3-261031 disclose the tip of the emitter which protrudes over the control electrode. However, those Kokais never disclose or suggest the advantages on characteristics and functions.

Although the invention has been described with respect to specific embodiment for complete and clear disclosure, the appended claims are not to be thus limited but are to be construed as embodying all modification and alternative constructions that may be occur to one skilled in the art which fairly fall within the basic teaching here is set forth.

What is claimed is:

1. A density-modulated type election gun, comprising:

a substrate being conductive on at least one surface thereof;

a plurality of electron emission electrodes provided on said one surface of said substrate;

an insulating layer provided on said one surface of said substrate, said insulating layer having a plurality of apertures for correspondingly exposing said plurality of electron emission electrodes;

a control electrode provided on said insulating layer, said control electrode having an exposed surface, said control electrode having a plurality of apertures, each of said control electrode apertures corresponding to a respective aperture of said insulating layer;

wherein said substrate, said plurality of electron emission electrodes, said insulating layer, and said control electrode comprise a field emission cathode;

a cavity which is resonant at a frequency of an RF input signal applied thereto, a part of said cavity comprising an anode facing said field emission cathode and operatively connected thereto, said anode having one or more apertures for passing electrons emitted from said field emission cathode;

a first direct current potential for applying a first voltage potential across said control electrode and said substrate; and a second direct current potential for applying a second voltage potential, relative to said cavity, at said anode;

wherein a first distance from said one surface of said substrate to respective tip portions of said plurality of electron emission electrodes is greater than a second distance from said one surface of said substrate to said exposed surface of said control electrode.

2. A density-modulated type electron gun, according to claim 1, wherein:

said one or more apertures of said anode comprise one or more meshed apertures, wherein each of said one or more meshed apertures correspond in position to a region of said field emission cathode containing said plurality of electron emission electrodes.

3. A density-modulated type electron gun, according to claim 2, wherein:

said field emission cathode further includes an additional control electrode, said additional control electrode being positioned on said control electrode and having apertures corresponding in location to respective apertures of said insulating layer.

4. A density-modulated type electron gun, according to claim 1, wherein:

said control electrode is provided at a periphery of said field emission cathode, and said field emission cathode further includes an additional control electrode which is positioned on and insulated from said control electrode.

5. An electron gun as claimed in claim 1, wherein said second voltage potential is substantially larger than said first voltage potential.

6. An electron gun as claimed in claim 5, wherein said second voltage potential is on the order of several tens of kilovolts and said first voltage potential is on the order of several tens of volts.

7. A density-modulated type election gun, comprising:

a substrate being conductive on at least one surface thereof;

a plurality of electron emission electrodes provided on said one surface of said substrate;

an insulating layer provided on said one surface of said substrate, said insulating layer having a plurality of apertures for correspondingly exposing said plurality of electron emission electrodes;

a control electrode provided on said insulating layer, said control electrode having an exposed surface, said control electrode having a plurality of apertures, each of said control electrode apertures corresponding to a respective aperture of said insulating layer;

wherein said substrate, said plurality of electron emission electrodes, said insulating layer, and said control electrode comprise a field emission cathode;

a cavity which is resonant at a frequency of an RF input signal applied thereto, a part of said cavity comprising an anode facing said field emission cathode and operatively connected thereto, said anode having one or more apertures for passing electrons emitted from said field emission cathode;

a first direct current potential for applying a first voltage potential across said control electrode and said substrate; and a second direct current potential for applying a second voltage potential, relative to said cavity, at said anode;

wherein a first distance from said one surface of said substrate to respective tip portions of said plurality of electron emission electrodes is greater than a second distance from said one surface of said substrate to said exposed surface of said control electrode;

wherein an RF electric field generated at the tip portion of said electron emission electrodes is maintained at a threshold value.

8. An electron gun as claimed in claim 7, wherein said second voltage potential is substantially larger than said first voltage potential.

9. An electron gun as claimed in claim 8, wherein said second voltage potential is on the order of several tens of kilovolts and said first voltage potential is on the order of several tens of volts.

10. A microwave tube, comprising:

a substrate being conductive on at least one surface thereof;

a plurality of electron emission electrodes provided on said one surface of said substrate;

an insulating layer provided on said one surface of said substrate, said insulating layer having a plurality of apertures for correspondingly exposing said plurality of electron emission electrodes;

a control electrode provided on said insulating layer, said control electrode having an exposed surface, said control electrode having a plurality of apertures, each of said control electrode apertures corresponding to a respective aperture of said insulating layer;

wherein said substrate, said plurality of electron emission electrodes, said insulating layer, and said control electrode comprise a field emission cathode;

an input cavity which is resonant at a frequency of an RF input signal applied thereto, a part of said input cavity comprising an anode facing said field emission cathode and operatively connected thereto, said anode having one or more apertures for passing electrons emitted from said field emission cathode, said field emission cathode and said input cavity comprising a density-modulated type electron gun;

a first direct current potential for applying a first voltage potential across said control electrode and said substrate; and a second direct current potential for applying a second voltage potential, relative to said input cavity, at said anode;

an output cavity operatively connected to said input cavity, said output cavity receiving said electrons passed through said one or more anode apertures of said density-modulated type electron gun; and a collector operatively connected to said output cavity for collecting said electrons from said output cavity;

wherein a first distance from said one surface of said substrate to respective tip portions of said plurality of electron emission electrodes is greater than a second distance from said one surface of said substrate to said exposed surface of said control electrode.

11. A microwave tube as claimed in claim 10, wherein said second voltage potential is substantially larger than said first voltage potential.

12. A microwave tube as claimed in claim 11, wherein said second voltage potential is on the order of several tens of kilovolts and said first voltage potential is on the order of several tens of volts.

13. A microwave tube, comprising:

a substrate being conductive on at least one surface thereof;

a plurality of electron emission electrodes provided on said one surface of said substrate;

an insulating layer provided on said one surface of said substrate, said insulating layer having a plurality of apertures for correspondingly exposing said plurality of electron emission electrodes;

a control electrode provided on said insulating layer, said control electrode having an exposed surface, said control electrode having a plurality of apertures, each of said control electrode apertures corresponding to a respective aperture of said insulating layer;

wherein said substrate, said plurality of electron emission electrodes, said insulating layer, and said control electrode comprise a field emission cathode;

an input cavity which is resonant at a frequency of an RF input signal applied thereto, a part of said input cavity comprising an anode facing said field emission cathode and operatively connected thereto, said anode having one or more apertures for passing electrons emitted from said field emission cathode, said anode and said control electrode having a potential difference therebetween which is provided by direct current potentials respectively applied thereto, said field emission cathode and said input cavity cooperating to provide a density-modulated type electron gun;

a slow-wave circuit operatively connected to said input cavity, said circuit allowing said electrons propelled through said one or more anode apertures and a microwave signal to interact; and a collector operatively connected to said output cavity for collecting said electrons after said electrons have interacted with said microwave signal;

wherein a first distance from said one surface of said substrate to respective tip portions of said plurality of electron emission electrodes is greater than a second distance from said one surface of said substrate to said exposed surface of said control electrode.

14. A microwave tube as claimed in claim 13, wherein said direct current potentials comprise:

a first direct current potential for applying a first voltage potential across said control electrode and said substrate; and a second direct current potential for applying a second voltage potential, relative to said input cavity, at said anode.

15. A microwave tube as claimed in claim 14, wherein said second voltage potential is substantially larger than said first voltage potential.

16. A microwave tube as claimed in claim 15, wherein said second voltage potential is on the order of several tens of kilovolts and said first voltage potential is on the order of several tens of volts.

17. A microwave tube, comprising:

a substrate being conductive on at least one surface thereof;

a plurality of electron emission electrodes provided on said one surface of said substrate;

an insulating layer provided on said one surface of said substrate, said insulating layer having a plurality of apertures for correspondingly exposing said plurality of electron emission electrodes;

a control electrode provided on said insulating layer, said control electrode having an exposed surface, said control electrode having a plurality of apertures, each of said control electrode apertures corresponding to a respective aperture of said insulating layer;

wherein said substrate, said plurality of electron emission electrodes, said insulating layer, and said control electrode comprise a field emission cathode;

an input cavity which is resonant at a frequency of an RF input signal applied thereto, a part of said input cavity comprising an anode facing said field emission cathode and operatively connected thereto, said anode having one or more apertures for passing electrons emitted from said field emission cathode, said field emission cathode and said input cavity cooperating to provide a density-modulated type electron gun;

a first direct current potential for applying a first voltage potential across said control electrode and said substrate; and a second direct current potential for applying a second voltage potential, relative to said input cavity, at said anode;

a slow-wave circuit operatively connected to said input cavity, said circuit allowing said electrons propelled through said one or more anode apertures and a microwave signal to interact; and a collector operatively connected to said output cavity for collecting said electrons after said electrons have interacted with said microwave signal;

wherein a first distance from said one surface of said substrate to respective tip portions of said plurality of electron emission electrodes is greater than a second distance from said one surface of said substrate to said exposed surface of said control electrode;

wherein an RF electric field generated at the tip portion of said electron emission electrodes is maintained at a threshold value.

18. A microwave tube as claimed in claim 17, wherein said second voltage potential is substantially larger than said first voltage potential.

19. A microwave tube as claimed in claim 18, wherein said second voltage potential is on the order of several tens of kilovolts and said first voltage potential is on the order of several tens of volts.

* * * * *